US005607617A

United States Patent [19]

Inoue et al.

[11] Patent Number: 5,607,617

[45] Date of Patent: Mar. 4, 1997

[54] ELECTROVISCOUS FLUIDS

[75] Inventors: Akio Inoue; Yoshio Suzuki, both of Fuji, Japan

[73] Assignee: Asahi Chemical Industry Co., Ltd., Japan

[21] Appl. No.: 209,807

[22] Filed: Jun. 22, 1988

[30] Foreign Application Priority Data

| | | | |
|---|---|---|---|
| Jun. 29, 1987 | [JP] | Japan | 62-159809 |
| Nov. 27, 1987 | [JP] | Japan | 62-297333 |
| Dec. 22, 1987 | [JP] | Japan | 62-322737 |
| Dec. 28, 1987 | [JP] | Japan | 62-329947 |
| Apr. 12, 1988 | [JP] | Japan | 63-88044 |

[51] Int. Cl.[6] ..... C09K 3/00; C10M 171/00; C10M 169/04

[52] U.S. Cl. ..... 252/73; 252/74; 252/75; 252/572

[58] Field of Search ..... 252/573, 572, 252/570, 73, 74, 75, 78.3

[56] References Cited

U.S. PATENT DOCUMENTS 3,397,147 8/1968 Martinek ..... 252/78.3

4,687,589 8/1987 Block et al. ..... 252/73

OTHER PUBLICATIONS

Grant & Hackh's Chemical Dictionary 5th edition, 1987, no month available "Semiconductor".

Sasada et al., Proceedings of the 17th Japan Congress on Materials Research, vol. 17, pp. 228–231, Mar. 1974.

CRC Handbook of Chemistry and Physics, 68th ed., pp. D–40, F–122, 1988 no month available.

*Primary Examiner*—Christine Skane

*Attorney, Agent, or Firm*—Finnegan, Henderson, Farabow, Garrett & Dunner, L.L.P.

[57] ABSTRACT

An electroviscous fluid which consists essentially of a non-conductive liquid and, dispersed therein, anhydrous spherical multilayered particles comprising particles at least whose surfaces are conductive and, formed thereon, a non-conductive layer having a thickness of about 0.1 to 1 μm. The electroviscous fluid is stable at both ambient temperature and elevated temperatures, i.e., up to at least about 200° C. in an applied electric potential with an alternating current or a pulsating direct current.

49 Claims, 2 Drawing Sheets

ELECTROVISCOUS FLUIDS

BACKGROUND OF THE INVENTION

1. FIELD OF THE INVENTION

The present invention relates to electroviscous fluids.

2. DESCRIPTION OF THE PRIOR ART

It is known that certain suspensions consisting of finely devided particles dispersed in a highly non-conductive liquid exhibit a remarkable increase in viscosity in an applied electric field. This effect is termed the Winslow Effect and these suspensions are termed electroviscous fluid of Winslow type. Most electroviscous fluids proposed heretofore comprise an electrically insulating liquid and, dispersed therein, a quantity of water-containing fine particles and are of Winslow type. According to two leading theories on the mechanism by which the electroviscous effect occurs, the dielectric polarization and the hydrogen bonding due to water existing on the surfaces of particles form bridges of the particles in an applied electric field. As the methods of increasing the electroviscous effect, there are proposed many types of fine particles useful for electroviscous fluids including, for example, particles obtained by incorporating an aqueous solution of a metal ion or a polar substance in between the layers of a substance having a lamination layer structure such as mica and vermiculite [Japanese Patent Publication (Kokoku) No. 5117/1974], water-containing particles of strongly acidic or strongly basic ion exchangers [Japanese Patent Publication (Kokai) No. 92278/1975], water-containing particles of a high water-absorptive resin having an acidic group such as polyacrylic acid (U.S. Pat. No. 4,129,513), particles of pyrogenic silica in which an acid such as formic acid, maleic acid and a base such as aniline, ethylenediamine, easily capable of forming a hydrogen bond, have been incorporated instead of water (U.S. Pat. No. 3,427,247), as particles containing no water, particles of a ferroelectric substance such as potassium titanate [J. Appl. Phys. 38 (1) 67 (1967) ], and particles of an organic semiconductor such as lamp black [J. Appl. Phys. 21, 402 (1950)] and poly(acene-quinone)polymer (U.S. Pat. No. 4,687,589). However, the electroviscous fluids comprising the above described particles have some problems. More specifically, according to the electro-viscous fluids using water-containing particles, due to the presence of water, the water migrates into both the inside of the particles and the vehicle of the particles or water is vaporized or electrolyzed and the current generated is rapidly increased with elevated temperatures. According to the electroviscous fluids using particles of an acid and a base and particles of a semiconducor, the current is rapidly increased with elevated temperature. Further, according to the electroviscous fluids using particles of a ferroelectric substance, the electroviscous effect is low.

In general, the electroviscous fluids proposed heretofore exhibit the electroviscous effect by the application of an electric potential with either an alternating current or a direct current but when an electric potential is continuously applied for a long period of time, such a tendency that the electric potential is slowly decreased or dielectric breakdown easily occurs can be observed. In order to prevent the tendency, the use of an electric potential with a pulsating direct current is proposed (U.K. Patent No. 2125230).

SUMMARY OF THE INVENTION

Accordingly, it is an object of the present invention to provide an electroviscous fluid which is stable at both low and elevated temperatures at the application of an electric potential for a long period of time with an alternating current or a pulsating direct current.

Other objects of the present invention will become apparent from the following description.

The present inventors have made extensive studies for the purpose of avoiding the above described disadvantages due to the presence of water by noticing the theory of dielectric polarization by which the electroviscous effect occurs and on the hypothesis that an electroviscous fluid containing, instead of water-containing particles, particles susceptible to dielectric polarization and capable of keeping the polarized charges induced with some strength on their surfaces can exhibit the electroviscous effect. As a result, it has now been found that anhydrous multilayered particles comprising particles at least whose surface is conductive and, formed thereon, a non-conductive layer in a non-conductive liquid have the charge polarization on their surfaces as described above and keep the polarized charges thus induced with some strength and that the electroviscous fluids containing such particles exhibit an excellent electroviscous effect even at elevated temperatures for a long period of time.

Thus, according to the present invention there is provided an electroviscous fluid consisting essentially of a non-conductive liquid and, dispersed therein, anhydrous multilayered particles comprising particles at least whose surfaces are conductive and, formed thereon, a non-conductive layer having a thickness of about 0.1 to about 1 μm.

The electroviscous fluid of the present invention stably exhibits excellent electroviscous effect at both ambient temperature and elevated temperatures, i.e., up to at least about 200° C. for a long period of time at the application of an electric potential with an alternating current and a pulsating current.

DETAILED DESCRIPTION OF PREFERRED EMBODIMENTS

Figure 1:
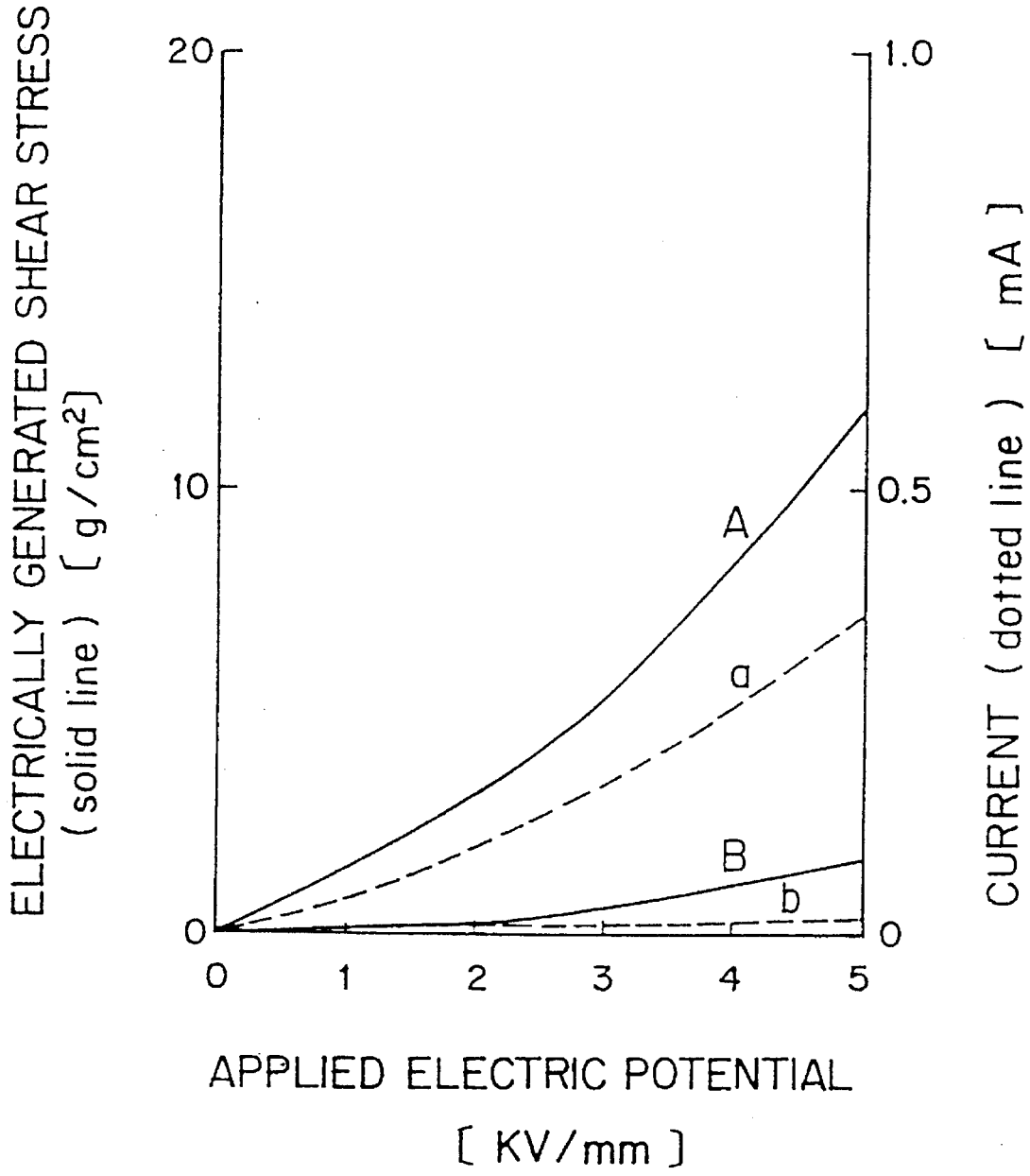
FIG. 1 depicts the variations of electrically generated shear stress and current at the application of an electric potential with an alternating current and a direct current to one embodiment of the electroviscous fluid of the present invention.

The particles at least whose surfaces are conductive according to the present invention include conductive particles as such, two-layered particles consisting of non-conductive particles and a conductive layer formed thereon and mixtures thereof, and have an electric conductivity of at least about $10^{-4}$ mho/cm, preferably more than about $10^{-2}$ mho/cm for producing an effective charge polarization in an applied electric field to induce the electroviscous effect.

Exemplary particles whose material as such is conductive include metals and alloys such as aluminum, nickel, copper, silicon, silver, duralumin and silumin; carbonaceous substances such as carbon black, graphite and spherical mesophase carbon; organic conductive polymers such as polythiophene and polypyrrole; conductive metal compounds such as copper sulfide, indium oxide, titanium boride, zinc bride, tungsten carbide and zinc carbide; solid electrolytes such as lithium peroxychloride/ethylene carbonate/polyacrylonitrile and solid sulfuric acid; and conductive blends or compounds of these conductive substances and non-conductive substances including organic polymers such as polystyrene and polyacrylonitrile and inorganic substances such as silica and alumina. Of these conductive particles, the metals, alloys and carbonaceous substances are excellent in heat resistance and stability at elevated temperatures for a long period of time, and especially aluminum, an aluminum alloy such as Al—Si alloy, Al—Mg alloy and Al—Cu alloy, silicon and carbon are low in density and preferred from the viewpoint of sedimentation.

Exemplary non-conductive particles of the two-layered particles include metal oxides such as silicon oxide and aluminum oxide; metal nitrides such as silicon nitride and aluminum nitride; metal hydroxides such as aluminum hydroxide; barium titanate; composite compounds thereof; carbonaceous substances such as coke, charcoal and asphalt; organic polymers such as polystyrene, polyamide, a styrene-divinylbenzene copolymer and phenolic resin; natural polymer compounds such as cellulose and starch.

The conductive layer formed on the surfaces of non-conductive particles is provided to induce a large amount of polarized charges on the surfaces of the two-layered particles in an applied electric field, and thus the conductive layer preferably has a high electric conductivity. The electric conductivity is typically at least abut $10^{-4}$ mho/cm and preferably more than abut $10^{-2}$ mho/cm.

The materials of the conductive layer which can be employed are the same as those of the conductive particles as described above.

Exemplary methods for forming the conductive layer on the non-conductive particles include chemical plating, physical plating such as vacuum evaporation and sputtering, solution or powder coating, surface reaction and surface polymerization. It is preferred that the conductive layer is formed on the entire surfaces of the non-conductive particles with a thickness as uniform as possible and that the formation of agglutinated particles is suppressed by controlling the conditions in forming the conductive layer by solution or powder coating and surface reaction or surface polymerization.

The thickness of the conductive layer for inducing a sufficient charge polarization is typically about 0.05 μm to one fourth of the diameter of non-conductive particles.

For practical purposes the sedimentation of the particles in the electroviscous fluid is a problem but such a problem can be solved by adjusting the density of the particles to that of the non-conductive liquid. It has now been found that the sedimentation of the particles can very effectively be prevented in a wide range of temperatures employed and viscosities of the non-conductive liquid employed by using conductive hollow particles or non-conductive hollow particles and adjusting the apparent density of the particles to the density of the non-conductive liquid.

By the term "hollow is meant herein, in relation to the conductive particle and the non-conductive particle, that the particle has one or more void spaces in its inside and the void space is surrounded with a wall of the material constituting the particle so that the non-conductive liquid cannot enter the void space. Of the void spaces, balloons which have one large spherical space are easy to prepare and accordingly preferred. The ratio of the void space occupying the particle is typically about 20 to about 80% by volume based on the total volume of the particle. With ratios of the void space of more than 80% by volume, the mechanical strength of the particle is low. On the other hand, with ratios of the void space of less than 20% by volume, the effect of the void space is too low.

As the hollow particles are preferred in the present invention a silicon oxide such as silica and an aluminum oxide such as alumina which are low in density but from the viewpoint of mechanical strength and conductivity, more preferred are a metal such as aluminum and an alloy such as Al—Si alloy, Al—Mg alloy and Al—Cu alloy.

Representative methods of preparing the conductive or non-conductive hollow particles, especially microballoons which can be employed in this invention are described in *MOL*, 19(6), 21(1981) and Asaji Kondo, "Microcapulse" (1970) (Kogyo Gijutsu Library 25, Business & Technology). Further, there can be employed a method of preparing the conductive or non-conductive hollow particles which comprises mixing a blowing agent or a void space-forming nucleating agent with the material for the particles and forming at least one void space within particles at or after shaping the particles. Among these methods, some methods produce particles having porous walls which the non-conductive liquid can enter, and it is necessary that such porous walls are sealed by melting or coating the surface of the particles.

When the difference between the density of the multilayered particles of the present invention and the density of the non-conductive liquid is less than about 0.4, preferably less than about 0.2, the sedimentation of the multi-layered particles in the electroviscous fluid can be prevented for a long period of time.

In the present invention the shape or form of the conductive or non-conductive particles, the conductive or non-conductive hollow particles, the two-layered particles consisting of the conductive particles or the conductive hollow particles and a non-conductive layer form thereon, the three-layered particles consisting of the non-conductive particles or the non-conductive hollow particles, a conductive layer formed thereon and a non-conductive layer formed on the conductive layer is spherical. By the term "spherical" is meant herein, in relation to the above described particles, that the shape or form of the particles is spherical, oval or bean-like. It is preferred that the particles are spheres.

The average diameter or longer diameter of the spherical particles is typically about 1 μm to about 100 μm and smaller average diameters are preferred from the viewpoint of the prevention of sedimentation and abrasion. With average diameters of smaller than 1 μm the bridge formation force among the particles is too weak to exhibit a sufficient electroviscous effect. Also, when the particle distribution is sharp, a superior electroviscous effect can be exhibited.

The non-conductive layer of the present invention is a thin layer of an insulating substance formed on the conductive particles or the conductive layer of two-layered particles and can prevent the charge polarization generated on the surfaces of the conductive particles or the conductive layer placed in an electric field from neutralizing electric charges by contact of the particles and causing dielectric breakdown with sparks by the formation of a circuit between the electrodes.

Exemplary insulating substances which can be employed in the present invention include organic synthetic polymer compounds such as polyvinylidene fluoride, polyimide, polyamide and polyacrylonitrile; organic natural polymer compounds such as wax, asphalt and varnish; and metal compounds metal oxides including aluminum oxide, silicon oxide and titanium oxide; metal hydroxides including aluminum hydroxide; barium titanate; metal or alloy chromates such as aluminum chromate, zinc chromate and aluminum alloy chromate; and metal nitrides such as aluminum nitride and silicon nitride. Of these compounds, the metal compounds are excellent in heat resistance and abrasion resistance and especially the metal oxides and the metal nitrides are strong against dielectric breakdown. Also the metal chromates are excellent in mechanical strength and strong against dielectric breakdown.

The volume or surface electric resistance of the non-conductive layer of the present invention is typically at least about $10^8$ ohm.cm, preferably more than about $10^{10}$ ohm.cm, and it is preferred that the non-conductive layer of the present invention has a higher breakdown strength and dielectric constant.

The thickness of the non-conductive layer is preferably as thin as possible and typically at most about 1 μm. With thicknesses of more than 1 μm the coulolmb force among particles is very small. On the other hand, with thicknesses of less than about 0.5 μm the coulomb force is easy to increase and an excellent electroviscous effect can be obtained. Thicknesses of the non-conductive layer of less than about 0.1 μm are not preferred for practical purposes since dielectric breakdown is easily caused at defective portions of the non-conductive layer and the abrasion resistance of the non-conductive layer is insufficnent.

Exemplary methods for forming the non-conductive layer on the conductive particles or the conductive layer of two-layered particles include physical plating such as vacuum evaporation, solution or powder coating, surface reaction and surface polymerization. It is preferred that the non-conductive layer is formed on the entire surfaces of the conductive particles or the conductive layer of two-layered particles with a thickness as uniform as possible and that the formatioin of agglutinated particles is suppressed in forming the non-conductive layer. As such coating methods a variety of methods which are described in Asaji Kondo, "Microcapsule" (Kogyo Gijutsu Library 25, Business & Technology) are preferably employed in the present invention. Furthermore, a method of selectively oxidizing or nitrogenating the surfaces of the conductive particles or the conductive layer by chemical treatment and a method of adsorbing a metal alkoxide on the surfaces of the conductive particles or the conductive layer and hydrolyzing or heat decomposing the metal alkoxide to form a metal oxide layer are preferably employed in the present invention.

In order for the electroviscous fluids of the present invention to be employed for a long period of time at elevated temperatures, i.e., up to at least about 200° C. or repeatedly, the adhesion of the non-conductive layer to the conductive particles or the conductive layer, and the abrasion resistance and the heat resistance of the non-conductive layer become important factors. From this viewpoint as the non-conductive layer are preferred metal oxides such as silicon oxide, aluminum oxide and titanium oxide, metal nitrides such as silicon nitride and aluminum nitride, and barium titanate. In particular, the combination of the metal such as aluminum and silicon or the metal alloy such as Al—Si alloy, Al—Mg alloy and Al—Cu alloy as the conductive particles and a non-conductive layer formed thereon by chemical treatment such as oxidation and nitrogenation is preferred and is suitable for the preparation of the multilayered particles of the present invention. For example, the method of forming a non-conductive layer on aluminum particles include treatments of the aluminum particles with warm water or an alkaline water to form an aluminum hydroxide layer, with chromic acid or phosphoric acid-chromic acid to form a chromate layer and with a gas of a high temperature such as oxygen, nitrogen or ammonia to form an aluminum oxide or aluminum nitride layer by oxidation or nitrogenation. Of these non-conductive layers, the formation of a chromate layer is preferred from the viewpoint of ease of controlling the thickness of the layer formed, dielectric breakdown strength and abrasion resistance. The aluminum hydroxide layer as such is weak in mechanical strength for a long period of use and its thickness is increased to obtain the same dielectric breakdown strength and as a result, the electroviscous effect tends to decrease. However, when part or a major part of the aluminum hydroxide layer is converted to aluminum oxide by heat treatment, the abrasion resistance and dielectric breakdown strength can be improved to become durable for a long period of use.

Also it is possible to improve the adhesion of the non-conductive layer to the conductive particles or to the conductive layer of three-layered particles or the adhesion of the conductive layer to the non-conductive particles by treating the surfaces of the conductive particles, the conductive layer or the non-conductive particles with a bonding agent including a coupling agent such as a silane coupling agent and an anchoring agent such as ethyleneimine, an epoxy resin or oxidizing the above described surfaces with sulfuric acid, nitric acid or hydrofluoric acid or chemically treating, for example, etching or physically treating the above described surfaces.

Any liquids having high electric insulation, heat resistance and electrochemical stability can be employed as the non-conductive liquids in the present invention. Furthermore, for practical purposes it is preferred that the non-conductive liquids have a low viscosity, low thermal dependence of viscosity, a high boiling point, a low vapor pressure, a low freezing point, a high density, high hydrophobicity, low toxicity and are inexpensive.

Exemplary non-conductive liquids include natural oils such as castor oil, cotton seed oil, linseed oil; synthetic oils such as silicone oils including dimethylsilicone oil and diphenylsilicone oil, fluorocarbon oils including oligohexafluoropropylene and oligotrifluorochloroethylene, paraffins including polybutene, halogenated aromatic oils including bromodiphenylmethane and trichlorodiphenylether, aromatic esters including dibutyl phthalate, dioctyl phthalate, tri-2-ethylhexyltrimellitate and tricresyl phosphate, aliphatic esters including isododecyl adipate and butyl sebacate and aromatic ethers including oligophenylene oxide; and mineral oils including cycloparaffins such as isopropylidenecyclohexane and 4-methyl-4-ethyl-1-cyclohexane, paraffins including isododecane and n-decane, and aromatics including n-hexylbenzene and n-octylbenzene.

When the electroviscous fluids of the present invention are employed at elevated temperatures, it is preferred that the non-conductive liquids have low thermal dependence of viscosity and a ratio of their viscosity at 100° C. to that at 20° C. of about 0.05 to about 1, especially about 0.1 to about 1. Representative examples of such non-conductive liquids are silicone oils.

The amount of the anhydrous multilayered particles in the electrovisous fluid which can be employed in the present invention is typically about 5 to about 50% by volume, preferably about 10 to about 40% by volume, based on the total volume of the electroviscous fluid.

By term "anhydrous" is meant herein, in relation to the multilayered particles, that the multilayered particles contain no adhesive moisture removable by drying at high temperatures under vacuum, and more specifically, they have a water content of at most 1% by weight, generally at most 0.5% by weight measured by a coulometric Karl Fisher's moisture meter in which range of water content the conventional electroviscous fluids consisting of water-containing particles and a non-conductive liquid hardly exhibit any electroviscous effect.

The electroviscous fluids of the present invention exhibit the electroviscous effect, i.e., an electrically generated shear stress by the application of an electric potential with an alternating current and a pulsating direct current but substantially not with a direct current. In contrast, the conventional electroviscous fluids consisting of water-containing particles and a non-conductive liquid generally exhibit the electroviscous effect with either an alternating current or a direct current. This phenomenon is thought to suggest that the mechanism by which the electroviscous effect occurs with the electroviscous fluids of the present invention greatly differs from that with the conventional electroviscous fluids. Furthermore, the electroviscous fluids of the present invention exhibit a superior electroviscous effect with high stability for a long period of time at both ambient temperature and elevated temperatures, i.e., up to at least about 200° C. This might be thought to relate to no deposition of the multilayered particles of the present invention on the electrodes since such a tendency that with the conventional electroviscous fluids water-containing particles move toward one or the both electrodes to deposit on the electrodes in the form of scales in an electric potential continuously for a long period of time can be observed, and to relate to the mechanism by which electroviscous effect occurs as described above.

Thus the electroviscous fluids of the present invention which exhibit the electroviscous effect at elevated temperatures for a long period of time by the application of an electric potential with an alternating current and a pulsating direct current are expected to be useful in actuators for torque converters such as clutchs, brakes and for hydraulic controllers such as shock absorbers, engine mounts and vibrating devices which cannot practically be realized by the conventional electroviscous fluids due to their durability at elevated temperatures.

The following examples and reference example illustrate the present invention in more detail. However, the invention is not restricted to these examples.

In these examples the electroviscous effect, electric conductivity, electric resistance, water content of particles and thickness of conductive and non-conductive layers were measured by the following methods. Electroviscous Effect:

In the space of 1.0 mm of a device consisting of a rotatable outer cup having an inner diameter of 40 mm and a stationary inner cup having an outer diameter of 38 mm having the same central axis as the outer cup and having an area of 40 $cm^2$ was placed an electroviscous fluid. Then the outer cup was rotated in such a manner that the sample was loaded with a shear rate of 200/sec and an electrically generated shear stress and a current were measured at the application of an electric potential. The alternating current employed in the following examples and reference example had a frequency of 50 Hz. The term "electrically generated shear stress" means herein the difference between the shear stress at the application of an electric potential and the apparent shear stress in the absence of any electric potential.

Electric Conductivity & Electric Resistance:

In a vertically set up Teflon® cylinder having an inner diameter of 20 mm and an electrode at its bottom was placed about one $cm^3$ of particles as the sample and placed thereon an electrode having a diameter of 20 mm and a weight of 100 g. Then an electric potential of 1 to 100 V was applied with a direct current between the electrodes. The electric conductivity and electric resistance were calculated from the current value after 30 seconds of the application of the electric potential.

Water Content of Particles:

The water content of particles was measured by a coulometric Karl Fisher's moisture meter provided with a water vaporization device (manufactured by Mitsubishi Chemical Corp., Type CA-02). More specifically, about one gram of particles was placed in a quartz boat, heated at 200° C. with dried nitrogen gas as a carrier gas to vaporize water, which was then led to the main body of the Karl-Fisher's moisture meter to measure the water content.

Thickness of Conductive and Non-Conductive Layers:

The thickness of the conductive layer and the non-conductive layer of particles was measured by the observation of the cross section of particles with a scanning electron microscope (manufactured by Akashi Works, "DC 130"), by an electron microanalyzer (manufactured by JEOL, "JCXA-733"), a thermogravimetric analyzer (manufactured by Seiko I&E, "SSC-580") and by extraction qauantitative analysis.

EXAMPLE 1

Spherical aluminum particles having an average particle diameter of 20 μm (product of Valimet Inc., "H-30") were immersed in an aqueous solution of 30° C. containing 1.5% by weight of chromic anhydride, 5.0% by weight of phosphoric acid and 1.0% by weight of sodium fluoride for 10 minutes, separated by filtration, thoroughly washed with water and dried at 70° C. for two days to give two-layered particles. It was confirmed that on the surfaces of the aluminum particles was formed an about 0.2 μm-thick chromate non-conductive layer and that the two-layered particles had an electric resistance of 5×10 ohm.cm and were substantially water-free, i.e., the water content was less than 1000 p.p.m.

Then an electroviscous fluid was prepared by dispersing the two-layered particles thus obtained in dried dimethylsilicone oil having a viscosity of 100 cSt in a nitrogen atmosphere without any moisture absorption in an amount of 15% by volume based on the total volume of the electroviscous fluid.

The electroviscous properties at 20° C. of the electroviscous fluid were evaluated by the application of an electric potential with the alternating current, a pulsating direct current having a pulse width of 10 msec and a square wave of duty ratio 1:1 and a direct current. In Table 1 are set forth the relations of applied electric potentials and electrically generated shear stresses in accordance with the respective method of applying electric potentials. The results are shown in Table 1.

TABLE 1

| Applied Electric Potential (KV/mm) | Method of Application of Electric Potential: Alternating Current Electrically Generated Shear Stress ($g/cm^2$) | Pulsating Direct Current Electrically Generated Shear stress ($g/cm^2$) | Direct Current Electrically Generated Shear Stress ($g/cm^2$) |
|---|---|---|---|
| 1.0 | 1.3 | 1.5 | 0 |
| 2.0 | 3.0 | 3.3 | 0 |
| 3.0 | 5.4 | 5.7 | 0 |
| 5.0 | 12.5 | 13.8 | 0 |

From the above described results, it can be understood that the electroviscous fluid of the present invention shows an electrically generated shear stress by the application of an electric potential with an alternating current and a pulsating current but not with a direct current.

Further, the durability of the electroviscous fluid as obtained above was tested by applying an electric potential of 2.0 KV/mm at 120° C. with the same alternating current and pulsating direct current as used above continuously for one week to the electroviscous fluid while every 24 hours the temperature for measuring the electrically generated shear stress was returned to 25° C. The results are set forth in Table 2.

From these results it can be understood that the electroviscous fluid of the present invention shows a very stable electroviscous effect at 120° C. for a long period of time and that it also shows a superior property with the ratio of electrically generated shear stress at 120° C. to that at 25° C. of approximately 1, compared to the conventional electroviscous fluids which show greatly varied electrically generated shear stresses with slightly varied temperatures even in the low temperature range.

TABLE 2

| Period of Measurement (days) | Method of Application of Electric Potential: Alternating Current: Electrically Generated Shear Stress 25° C. ($g/cm^2$) | Alternating Current: Electrically Generated Shear Stress 120° C. ($g/cm^2$) | Alternating Current: Ratio of Electrically Generated Shear Stress 120 C/25° C. | Pulsating Direct Current: Electrically Generated Shear Stress 25° C. ($g/cm^2$) | Pulsating Direct Current: Electrically Generated Shear Stress 120° C. ($g/cm^2$) | Pulsating Direct Current: Ratio of Electrically Generated Shear Stress 120 C/25° C. |
|---|---|---|---|---|---|---|
| 1 | 3.1 | 4.2 | 1.4 | 3.3 | 4.8 | 1.5 |
| 3 | 3.0 | 4.1 | 1.4 | 3.1 | 4.4 | 1.4 |
| 5 | 3.0 | 4.0 | 1.3 | 3.1 | 4.4 | 1.4 |
| 7 | 3.0 | 4.0 | 1.3 | 3.1 | 4.4 | 1.4 |

EXAMPLE 2

The same spherical aluminum particles as in Example 1 were added to an aqueous solution containing 1% by weight of potassium hydroxide. The mixture thus obtained was slowly stirred at 25° C. for 8 hours and then the particles were separated by filtration, thoroughly washed with water, transferred into methanol to almost completely substitute water with methanol and subsequently dried at 120° C. for 48 hours under vacuum to give two-layered particles. It was confirmed that the two-layered particles did not have free water, that on the surfaces of the aluminum particles was formed an about 0.25 μm-thick aluminum hydroxide layer and that the electric resistance of the two-layered particles was $8\times10^{11}$ ohm.cm.

The two-layered particles thus obtained were dispersed in dried tri-2-ethylhexyl trimellitate (product of Kao Corp., "Trimex-T08") in nitrogen atmosphere without any moisture absorption in an amount of 20% by volume based on the total volume of the resulting electroviscous fluid.

The electroviscous properties at 25° C. of the electroviscous fluid were evaluated by the application of electric potentials as set forth in FIG. 1 with the alternating current and a direct current at a shear rate of 200/sec.

FIG. 1 depicts the variations of electrically generated shear stress ($g/cm^2$) by a solid line and current (mA) by a dotted line as ordinate with applied electric potential (KV/mm) as abscissa. Current A and a. show electrically generated shear stress and current, respectively, by the application of an electric potential with the alternating current and curves B and b show those by the application of an electric potential with the direct current.

From FIG. 1 it can be understood that the electroviscous fluid of the present invention hardly produces an electrically generated shear stress and a current with a direct current but it shows a sufficient electroviscous effect wiht an alternating current.

EXAMPLE 3

The same procedures for preparing two-layered particles as in Example 2 were repeated except that the period for the treatment of the spherical aluminum particles with potassium hydroxide was varied as set forth in Table 3.

Then electroviscous fluids were prepared using the two-layered particles thus obtained in the same manner as in Example 2 and an electric potential of 3.0 KV/mm with the alternating current was applied to the electroviscuous fluids at 25° C. The results are set forth in Table 3.

TABLE 3

| Experiment No. | Period for Treatment (hours) | Thickness of Non-Conductive Layer (μm) | Electrically Shear Stress ($g/cm^2$) | Current (mA) |
|---|---|---|---|---|
| 1 | 4 | 0.12 | 6.2 | 0.22 |
| 2 | 24 | 0.45 | 4.7 | 0.26 |
| 3 | 48 | 0.91 | 3.1 | 0.27 |
| 4 | 72 | 1.3 | 0.6 | 0.27 |

From these results it can be understood that with thicknesses of the non-conductive layer of more than 1 μm the electrically generated shear stress is remarkably increased.

EXAMPLE 4

The same two-layered particles as obtained in Example 2 were further heated at 650° C. in nitrogen gas to convert the aluminum hydroxide layer to an aluminum oxide layer. The two-layered particles thus obtained had an electric resistance of $3\times10^{12}$ ohm-cm.

Electroviscous fluids were prepared by dispersing the two-layer particles and water-containing cellulose particles having a water-content of 6.2% by weight (product of Asahi Chemical Ind. Co., "AVICEL") as a comparison into the same tri-2-ethylhexyl trillitate as in Example 2, respectively, in an amount of 20% by volume based on the total amount of the electroviscous fluids.

The electroviscous properties were evaluated by the application of an electric potential with the alternating current at a shear rate of 200/sec at 25° C. The results are shown in FIG. 2.

Figure 2:
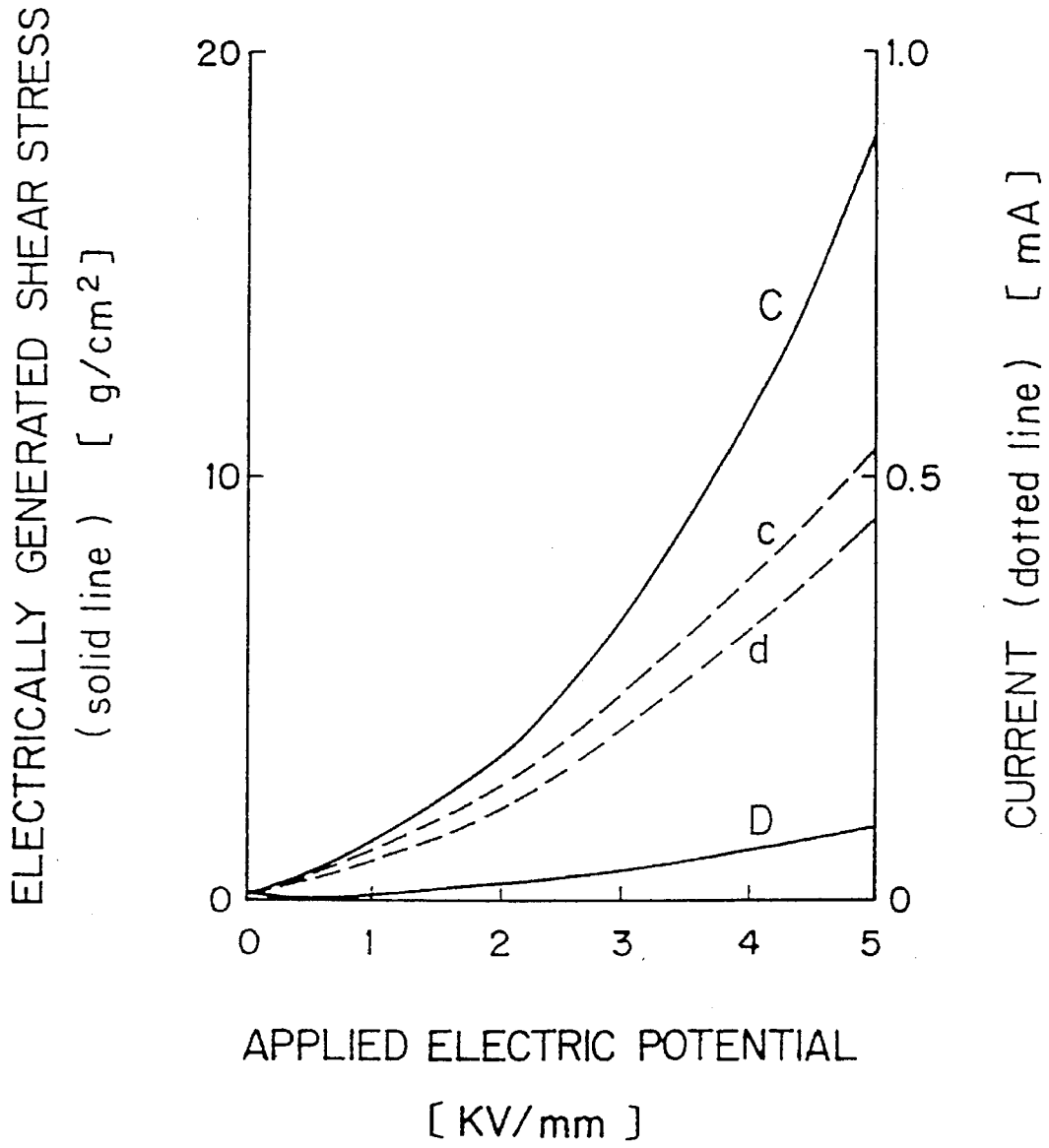
FIG. 2 depicts the variations of electrically generated shear stress and current at the application of an electric potential with an alternative current to one embodiment and one reference example of the electroviscous fluid of the present invention.

FIG. 2 depicts the variations of electrically generated shear stress (g/cm$^2$) by a solid line and current (mA) by a dotted line as ordinate with applied electric potential (KV/mm) as abscissa. Curves C and c show electrically generated shear stress and current, respectively, by the application of an electric potential with the alternating current to the electroviscous fluid of the present invention, Curves D and d show those by the application of an electric potential with the alternating current to the comparative electroviscous fluid.

From FIG. 2 it can be understood that the electroviscous fluid of the present invention produces a high electrically generated shear stress and a current with an alternating current and that it shows a sufficient electroviscous effect, while the comparative electroviscous fluid hardly produces an electrically generated shear stress and a current. Further, when the electric potential with a direct current was applied to the electroviscous fluid of the present invention, the electrically generated shear stress and curent were not observed.

EXAMPLE 5

Spherical silica particles having an average particle diameter of 5 μm (product of Misawa Chemical Co., "AMT-500") were dipped in a stannous chloride type sensitizer (product of Okuno Pharmaceutical Co., "TMP Sensitizer"), separated by filtration, washed with water, dipped in a palladium chloride type activator (product of Okuno Pharmaceutical Co. "TMP Activator"), separated by filtration, washed with water, subsequently immersed in a nickel type chemical plating solution (product of Okuno Pharmaceutical Co., "Topnicoron") at 90° C. for 30 minutes with slow stirring, and separated by filtration. As a result, a nickel-plated layer of 0.2 μm in average thickness was formed on the surfaces of the silica particles.

Then the two-layered particles thus obtained were dipped in toluene containing 1% by weight of aluminum isopropoxide, separated by filtration, added into a large amount of ethanol containing 0.5% by weight of water and slowly stirred to form a layer of aluminum oxide, i.e., hydrohyzate of aluminum isopropoxide on the surfaces of the two-layered particles. The three-layered particles thus obtained were separated by filtration and subjected to heat treatment at 300° C. for 30 minutes in a nitrogen atmosphere to improve the strength of the layer. The series of the above described steps for forming the aluminum oxide layer were repeated three times to give an aluminum oxide layer of 0.2 μm in average thickness having a high strength of dielectric breakdown on the surfaces of the two-layered particles.

Then an electroviscous fluid was prepared by dispersing the three-layered particles in dimethylsilicone oil having a viscosity of 100 cSt in an amount of 15% by volume based on the total volume of the electroviscous fluid. The electroviscous properties were evaluated by the application of electric potentials as set forth in Table 4 with the alternating current at 25° C. The results are shown in Table 4.

TABLE 4

| Applied Electric Potential (KV/mm) | Electrically Generated Shear Stress (g/cm$^2$) | Current (mA) |
|---|---|---|
| 1.0 | 0.5 | 0.05 |
| 2.0 | 1.8 | 0.12 |
| 3.0 | 4.0 | 0.26 |
| 5.0 | 10.6 | 0.52 |

Further, shearing was applied to the same electroviscous fluid as obtained above at a shear rate of 200/sec under heating at 120° C. for 24 hours in an electric potential of 2.0 KV/mm with the alternating current. The results are set forth in Table 5.

TABLE 5

| Time of Measurement | Electrically Generated Shear Stress (g/cm$^2$) |
|---|---|
| Before Heating (25° C.) | 1.8 |
| During Heating (120° C.) | 2.0 |
| After Heating (25° C.) | 1.8 |

From these results it could be understood that the electrically generated shear stresses before, during and after heating at 120° C. are almost constant and that the electroviscous fluid shows a very stable electroviscuous effect.

For comparison, the spherical silica particles were placed in a moisturizing atmosphere to give spherical silica particles having a water content of 9% by weight. An electroviscous fluid was prepared by dispersing the spherical silica particles thus obtained in dimethylsilicone oil in an amount of 15% by volume based on the total volume of the electroviscous fluid. The electroviscous fluid showed an electrically generated shear stress of 2.5 g/cm$^2$ by the application of an electric potential of 2.0 KV/mm with the alternating current at 25° C. but the electroviscous fluid after heated at 70° C. for 24 hours showed hardly any electrically generated shear stress.

EXAMPLE 6

An aqueous uniform mixture solution containing 84% by weight of styrene, 5% by weight of divinylbenzene, 5% by weight of carbon black and 1% by weight of dibenzoyl peroxide was added to an aqueous solution containing 5% by weight of polyvinyl alcohol, and the mixture was vigorously stirred at 80° C. to conduct polymerization. As a result, polymer microbeads having an average particle diameter of 60 μm and an electric resistance of $1\times10^2$ ohm.cm were obtained. Then by air suspension coating method using polyvinylidene fluoride dissolved in N,N-dimethylacetamide was formed a polyvinylidene fluoride layer having an average thickness of 0.15 μm on the surfaces of the polymer microbeads. The electric resistances of the polyvinylidene fluoride employed and the polymer beads having a polyvinylidene fluoride layer on their surfaces were $4\times10^{13}$ ohm.cm and $6\times10^{12}$ ohm.cm, respectively.

Then an electroviscous fluid was prepared by dispersing the polymer microbeads having a polyvinylidene fluoride layer on their surfaces into fluorocarbon oil (product of E. I. Du Pont De Nemours & Co., "KRYTOX 143AY") in an amount of 30% by volume based on the total volume of the electroviscous fluid. This electroviscous fluid showed an electrically generated shear stress of 5.3 g/cm$^2$ and a current of 0.2 mA by the application of an electric potential of 3.0 KV/mm with the alternating current at 25° C.

Further, when the thickness of the polyvinylidene fluoride layer was increased to 0.6 μm and 1.1 μm, the electrically generated shear stress was 4.1 g/cm$^2$ and 0.4 g/cm$^2$, respectively.

EXAMPLE 7

Spherical borosilicate type silica balloons having an average particle diameter of 30 μm, an average particle apparent density of 0.8 and an average void ratio of 65 % by volume (product of Asahi Glass Co., "Q-Cel") were dipped in an aqueous 0.2% by weight stannous chloride solution as a sensitizer, separated by filtration, washed with water, then dipped in an aqueous 0.02% by weight palladium chloride solution as an activator, separated by filtration, washed with water and subsequently immersed in an aqueous solution containing nickel chloride, sodium hypophosphate and sodium acetate as a nickel chemical plating solution at 90° C. for 30 minutes under slow stirring and separated by filtration. As a result, a nickel-plated layer of about 0.3 μm in thickness was formed on the surfaces of the balloons.

Then the balloons thus obtained were dipped in toluene containing 1% by weight of aluminum isopropoxide, separated by filtration, added into a large amount of ethanol containing 0.5% by weight of water and slowly stirred to form an aluminum oxide layer on the surfaces of the nickel-plated layer of the balloons. The three-layered balloons thus obtained were separated by filtration and subjected to heat treatment at 300° C. for 30 minutes in a nitrogen atmosphere to improve the strength of the layer. The series of the above described steps for forming the aluminum oxide layer were repeated three times to give an about 0.3 μm-thick aluminum oxide layer on the nickel-plated layer of the balloons.

Then an electroviscous fluid was prepared by dispersing the three-layer balloons thus obtained into dimethylsilicone oil in an amount of 20 % by volume based on the total volume of the electroviscous fluid. The apparent density of the three-layered balloons was 0.98 and the density of the dimethylsilicone oil was 0.97. Thus the difference in density was less than 0.01. When the electroviscous fluid was left to stand at 25° C. for 3 days, the electroviscous fluid kept a uniform dispersion with almost no sedimentation of the balloons although about 5% by volume of the balloons floated.

The electroviscous fluid showed an electrically generated shear stress of 6.0 g/cm$^2$ by the application of an electric potential of 3.0 KV/mm with the alternating current at 25° C.

EXAMPLE 8

Spherical aluminum particles having an average particle diameter of 5 μm (product of Valimet Inc., "H-5") were dipped in an aqueous solution containing 0.01% by weight of γ-methacryloxypropyltrimethoxysilane (product of Toshiba Silicone Co., "TSL 8370") as a silane coupling agent, separated by filtration and transferred into heptane at 65° C. Then to the mixture was slowly added dropwise acrylonitrile containing 1% by weight of dibenzoyl peroxide with stirring at a high rate of 300 r.p.m. to form an almost uniform polyacrylonitrile layer on the surfaces of the aluminum particles. The thickness of the polyacrylonitrile layer was abut 0.12 μm.

Then an electroviscous fluid was prepared by dispersing the two-layered particles thus obtained into the same fluorocarbon oil as employed in Example 7 in an amount of 20% by volume based on the total volume of the electroviscous fluid. This electroviscous fluid showed an electrically generated shear stress of 3.8 g/cm$^2$ by the application of an electric potential of 3.0 KV/mm with the alternating current at 25° C.

EXAMPLE 9

Spherical beads of styrene-divinylbenzene copolymer having an average particle diameter of 5.3 μm and a 0.15 μm-thick nickel-plated layer on their surfaces (product of Japan Synthetic Rubber Co., "MPP-S-2463") were dipped in n-hexane containing 0.25% by weight of titanium isopropoxide to form a thin layer of titanium isopropoxide, separated by filtration and dried in air for about 30 minutes, subsequently at 120° C. for 3 hours under vacuum. This treatment with titanium isopropoxide was repeated three times to form a 0.2 μm-thick titanium oxide layer on the surfaces of the nickel-plated layer, i.e., to give three-layered particles.

The three-layer particles thus obtained had a water content of at most 0.5% by weight and an electric resistance of $8.3\times10^{12}$ ohm.cm.

Then an electroviscous fluid was prepared by dispersing the three-layered particles in dimethylsilicone oil having a viscosity of 50 cSt in an amount of 30% by volume based on the total volume of the electroviscous fluid. The electroviscous fluid thus obtained showed an electrically generated shear stress of 7.5 g/cm$^2$ and a current of 0.27 mA by the application of an electric potential of 3.0 KV/mm with the alternating current at 25° C.

EXAMPLE 10

An about 0.2 μm-thick chromate layer was formed on spherical particles of aluminum-silicon alloy having an average partical diameter of 40 μm (product of Toyo Aluminum Co., silicon content: 13% by weight) in the same manner as in Example 1 except that the immersion of the particles in the aqueous solution containing the chromic anhydride was conducted at 70° C. for one hour.

Then an electroviscous fluid was prepared by dispersing the two-layered particles in dimethylsilicone oil having a viscosity of 500 cSt in an amount of 20% by volume based on the total volume of the electroviscous fluid. The electroviscous properties of the electroviscous fluid thus obtained were measured by the application of an electric potential as set forth in Table 5 with the alternating current at 25° C. The results are set forth in Table 5.

TABLE 6

| Applied Electric Potential (KV/mm) | Electrically Generated Shear Stress ($g/cm^2$) | Current (mA) |
|---|---|---|
| 1.0 | 1.5 | 0.04 |
| 2.0 | 4.1 | 0.13 |
| 3.0 | 8.3 | 0.28 |

EXAMPLE 11

Spherical conductive carbon particles having an average particle diameter of 8 μm and an electric conductivity of $10^3$ mho/cm (product of Kansai Tar Co., "Mesocabon") were immersed in benzene containing 2% by weight of dibenzoyl peroxide at 60° C., slowly stirred for 4 days and separated by filtration. The particles thus treated were added to heptane at 65° C. and then acrylonitrile containing 1% by weight of dibenzoyl perioxide was slowly added dropwise to the mixture with stirring at a high rate of 300 r.p.m. to form a 0.15 μm-thick polyacrylonitrile layer on the particles.

The two-layer particles thus obtained had a water content of 0.1% by weight and an electric resistance of $6.5\times10^{13}$ ohm.cm.

Then an electroviscous fluid was prepared by dispersing the two-layered particles in the same dried tri-2-ethylhexyl trimellitate as in Example in an amount of 20% by volume based on the total volume of the electroviscous fluid. The electroviscous fluid thus obtained showed an electrically generated shear stress of 3.3 $g/cm^2$ by the application of an electric potential of 3.0 KV/mm with the alternating current at 25° C.

EXAMPLE 12

Conductive hollow particles of alumina whose surfaces were coated with silver by chemical plating and having an average particle diameter of 50 μm (product of Showa Denko Kabushiki Kaisha, "EXTENDSPHERES METALITE-Ag") were treated with titanium isopropoxide in the same manner as in Example 9 to form an about 0.2 μm-thick titanium oxide layer on the surfaces of the silver-plated layer, i.e., to give three-layered particles.

The three-layered particles thus obtained had an electric resistance of $4\times10^{12}$ ohm.cm.

Then an electroviscous fluid was prepared by dispersing the three-layered particles in dimethylsilicon oil having a viscosity of 100 cSt in an amount of 20% by volume based on the total volume of the electroviscous fluid. When a pair of flat electrodes whose space therebetween was 1 mm was placed in the electroviscous fluid and an electric potential of 1.0 KV/mm with the alternating current at 25° C. bridges of the three-layered particles were formed and the electroviscous fluid did not flow as if it were in a solidified state.

Reference Example

An about 0.2 μm-thick chromate layer was formed on pulverized aluminum particles whose shape was indeterminate and which had an average particle diameter of 20 μm in the same manner as in Example 1 and then an electroviscous fluid was prepared by dispersing the two-layer particles thus obtained into dimethylsilicone oil having a viscosity of 100 cSt in an amount of 15% by volume based on the total volume of the electroviscous fluid. The durability of the electroviscous fluid was tested by the continuous application of an electric potential of 2.0 KV/mm at 120° C. with the alternating current. As a result, the electrically generated shear stress was 2.8 $g/cm^2$ corresponding to about two third of that of Example 1, and 4 hours after the initiation of applying the electric potential, dielectric breakdown occured.

What is claimed is:

1. An electroviscous fluid which consists essentially of a non-conductive liquid and, dispersed therein, anhydrous spherical multilayered particles comprising particles at least whose surfaces are conductive and, formed thereon, a non-conductive layer having a thickness of about 0.1 to about 1 μm.

2. An electroviscous fluid of claim 1, wherein the anhydrous spherical multilayered particles are two-layered particles comprising conductive particles and, formed thereon, a non-conductive layer having a thickness of abut 0.1 to about 1 μm.

3. An electroviscous fluid of claim 1, wherein the anhydrous spherical multilayered particles are three-layered particles comprising non-conductive particles, a conductive layer formed thereon and a non-conductive layer having a thickness of about 0.1 to about 1 μm formed on the conductive layer.

4. An electroviscous fluid of claim 1, claim 2 or claim 3, wherein the non-conductive layer has an electric resistance of at least about $10^8$ ohm.cm.

5. An electroviscous fluid of claim 4, wherein the non-conductive layer has an electric resistance of at least about 10 ohm.cm.

6. An electroviscous fluid of claim 4, wherein the non-conductive layer is a metal compound, an organic synthetic polymer or an organic natural polymer compound.

7. An electroviscous fluid of claim 6, wherein the metal compound is a metal oxide, a metal hydroxide, a metal nitride, a metal chromate, an alloy chromate or barium titanate.

8. An electroviscous fluid of claim 7, wherein the metal compound is a metal chromate.

9. An electroviscous fluid of claim 8, wherein the metal chromate is aluminum chromate or zinc chromate.

10. An electroviscous fluid of claim 7, wherein the metal compound is a metal oxide.

11. An electroviscous fluid of claim 10, wherein the metal oxide is aluminum oxide, silicon oxide or titanium oxide.

12. An electroviscous fluid of claim 7, wherein the metal compound is a metal nitride.

13. An electroviscous fluid of claim 12, wherein the metal nitride is aluminum nitride or silicon nitride.

14. An electroviscous fluid of claim 7., wherein the metal compound is a metal hydroxide.

15. An electroviscous fluid of claim 14, wherein the metal hydroxide is aluminum hydroxide.

16. An electroviscous fluid of claim 6, wherein the organic synthetic polymer is polyvinylidene fluoride or polyacrylonitrile.

17. An electroviscous fluid of claim 2, wherein the conductive particles has an electric conductivity of at least about $10^{-4}$ mho/cm.

18. An electroviscous fluid of claim 17, wherein the conductive particles has an electric conductivity of at least abut $10^{-2}$ mho/cm.

19. An electroviscous fluid of claim 17, wherein the conductive particles are a metal, an alloy, a carbonaceous substance, an organic conductive polymer, a conductive metal compound, a solid electrolyte or a conductive blend of the conductive substance and a non-conductive substance.

20. An electroviscous fluid of claim 19, wherein the metal is aluminum, nickel, copper or silicon.

21. An electroviscous fluid of claim 19, wherein the alloy is duralumin or silumin.

22. An electroviscous fluid of claim 19, wherein the carbonaceous substance is graphite, carbon black or mesophase carbon.

23. An electroviscous fluid of claim 3, wherein the conductive layer has an electric conductivity of at least about $10^{-4}$ mho/cm.

24. An electroviscous fluid of claim 23, wherein the conductive layer has a thickness of about 0.05 μm to one fourth of the average particle diameter of the conductive particles.

25. An electroviscous fluid of claim 24, wherein the conductive layer is a metal or an alloy.

26. An electroviscous fluid of claim 24, wherein the metal is nickel, zinc, copper, silicon, silver or aluminum.

27. An electroviscous compound of claim 3, wherein the non-conductive particles is a metal oxide, a metal nitride, a metal hydroxide, barium titanate, a carbonaceous substance, an organic polymer or a natural polymer compound.

28. An electroviscous compound of claim 27, wherein the metal oxide is silicon oxide or aluminum oxide.

29. An electroviscous compound of claim 27, wherein the organic polymer is a styrene-divinylbenzene copolymer.

30. An electroviscous fluid of claim 2, wherein the conductive particles are conductive hollow particles.

31. An electroviscous fluid of claim 30, wherein the conductive hollow particles have a ratio of the void space of about 20 to about 80% by volume based on the total volume of the conductive hollow particles.

32. An electroviscous fluid of claim 21, wherein the conductive hollow particles are a metal or an alloy.

33. An electroviscous fluid of claim 32, wherein the metal is aluminum.

34. An electroviscous fluid of claim 32, wherein the alloy is Al—Si alloy, Al—Mg alloy or Al—Cu alloy.

35. An electroviscous fluid of claim 3, wherein the non-conductive particles are non-conductive hollow particles.

36. An electroviscous fluid of claim 35, wherein the non-conductive hollow particles have a ratio of the void space of about 20 to about 80% by volume based on the total volume of the non-conductive hollow particles.

37. An electroviscous fluid of claim 36, wherein the non-conductive hollow particles are silicon oxide or aluminum oxide.

38. An electroviscous fluid of claim 31, wherein the conductive hollow particles are balloons.

39. An electroviscous fluid of claim 36, wherein the non-conductive hollow particles are balloons.

40. An electroviscous fluid of claim 1, wherein the difference between the density of the anhydrous spherical multilayered particles and that of the non-conductive liquid is less than about 0.4.

41. An electroviscous fluid of claim 40, wherein the difference between the density of the anhydrous spherical multilayered particles and that of the non-conductive liquid is less than about 0.2.

42. An electroviscous fluid of claim 1, wherein the amount of the anhydrous multilayered particles is about 5 to about 50% by volume based on the total volume of the electroviscous fluid.

43. An electroviscous fluid of claim 42, wherein the amount of the anhydrous multilayered particles is about 10 to 40% by volume based on the total volume of the electroviscous fluid.

44. An electroviscous fluid of claim 1, wherein the non-conductive liquid has a ratio of the viscosity at 100° C. to that at 20° C. of about 0.05 to about 1.

45. An electroviscous fluid of claim 44, wherein the non-conductive liquid has a ratio of the viscosity at 100° C. to that at 20° C. of about 0.1 to about 1.

46. An electroviscous fluid of claim 1, wherein the non-conductive liquid is a synthetic oil, a mineral oil or a natural oil.

47. An electroviscous fluid of claim 46, wherein the synthetic oil is a silicone oil, a fluorocarbon oil, a paraffin, a halogenated aromatic oil, an aromatic ester, an aliphatic ester or an aromatic ether.

48. A method of varying the viscosity of the electroviscous fluid of claim 1 by the application of an electric potential with an alternating current.

49. A method of varying the viscosity of the electroviscous fluid of claim 1 by the application of an electric potential with a pulsating direct current.

* * * * *